US007315138B2

(12) United States Patent
Usami et al.

(10) Patent No.: US 7,315,138 B2
(45) Date of Patent: Jan. 1, 2008

(54) COLD CATHODE FLUORESCENT DISCHARGE LAMP APPARATUS AND OPERATING METHOD FOR SAME

(75) Inventors: Yoshihiko Usami, Kanagawa (JP); Norimasa Furukawa, Tokyo (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 11/483,866

(22) Filed: Jul. 10, 2006

(65) Prior Publication Data

US 2007/0024206 A1 Feb. 1, 2007

(30) Foreign Application Priority Data

Jul. 28, 2005 (JP) ..... 2005-218672

(51) Int. Cl.
*G05F 1/00* (2006.01)

(52) U.S. Cl. ..... 315/291; 315/307; 315/224

(58) Field of Classification Search ..... 315/291, 315/307–309, 297, 224
See application file for complete search history.

(56) References Cited

U.S. PATENT DOCUMENTS 5,914,571 A * 6/1999 Beasley ..... 315/244
6,211,623 B1 * 4/2001 Wilhelm et al. ..... 315/224
6,998,793 B2 * 2/2006 Sheng ..... 315/276
2006/0038513 A1 * 2/2006 Henry ..... 315/291
2007/0052371 A1 * 3/2007 Fukuda et al. ..... 315/291

FOREIGN PATENT DOCUMENTS

JP 10-335084 A 12/1998
JP 2001-237093 A 8/2001

* cited by examiner

*Primary Examiner*—Tuyet Vo
(74) *Attorney, Agent, or Firm*—Lerner, David, Littenberg, Krumholz & Mentlik, LLP

(57) ABSTRACT

A discharge lamp operating device includes a voltage application unit that applies to a discharge lamp an alternating-current (AC) voltage for operation of the discharge lamp, and a frequency setting unit that sets a frequency of the AC voltage to a first frequency for ignition of the discharge lamp and sets the frequency of the AC voltage to a second frequency during operation of the discharge lamp after the ignition. In the discharge lamp operating device, the second frequency is lower than the first frequency.

9 Claims, 5 Drawing Sheets

COLD CATHODE FLUORESCENT DISCHARGE LAMP APPARATUS AND OPERATING METHOD FOR SAME

CROSS-REFERENCE TO RELATED APPLICATIONS

The present application claims priority from Japanese Patent Application No. JP 2005-218672 filed on Jul. 28, 2005, the disclosure of which is hereby incorporated by reference herein.

BACKGROUND OF THE INVENTION

1. Field of the Invention

The present invention relates to a device and a method for operating a discharge lamp. The invention also relates to a light source device and a display that include the discharge lamp operating device.

2. Description of the Related Art

Liquid crystal displays that employ a liquid crystal panel as a display unit are widely prevalent. As is well known, the liquid crystal panels are not self-luminous devices. Therefore, the liquid crystal panels allow the passage therethrough of light emitted from a light source device referred to as a so-called backlight, and modulate the passing light based on video signals to thereby display images.

Currently, discharge lamps such as cold cathode fluorescent lamps are widely used as a light source of the liquid crystal display. Such discharge lamps have advantages of a long life, no necessity for heating for operation thereof, etc.

In general, such discharge lamps are operated by application of AC voltage thereto. For application of AC voltage to a discharge lamp, an inverter is used. The inverter converts a DC supply voltage to an AC supply voltage. Applying a voltage as the AC supply voltage to a discharge lamp allows the operation of the discharge lamp. A related-art example is disclosed in e.g. Japanese Patent Laid-Open No. Hei 10-335084.

It is known that when a discharge lamp is operated through AC driving, leakage current from the discharge lamp arises. The occurrence of leakage current during the operation of the discharge lamp correspondingly reduces the amount of current flowing through the discharge lamp. This current reduction possibly causes e.g. a decrease in the luminance and an increase in reactive power during the operation of the discharge lamp. Therefore, it is preferable that leakage current during the operation of a discharge lamp be reduced as far as possible.

SUMMARY OF THE INVENTION

In consideration of the above-described problem, one embodiment of the present invention provides a discharge lamp operating device having the following configuration.

Specifically, the discharge lamp operating device includes a voltage application unit that applies to a discharge lamp an AC voltage for operation of the discharge lamp, and a frequency setting unit that sets the frequency of the AC voltage to a first frequency for ignition of the discharge lamp and sets the frequency of the AC voltage to a second frequency during operation of the discharge lamp after the ignition. The second frequency is lower than the first frequency.

According to another embodiment of the invention, there is provided a light source device that includes a voltage application unit that applies to a discharge lamp forming a light source an AC voltage for operation of the discharge lamp, and a frequency setting unit that sets the frequency of the AC voltage to a first frequency for ignition of the discharge lamp and sets the frequency of the AC voltage to a second frequency during operation of the discharge lamp after the ignition. The second frequency is lower than the first frequency.

According to further another embodiment of the invention, there is provided a display with the following configuration.

Specifically, the display includes a light source device and an image display panel that displays an image by use of light emitted from the light source device. Furthermore, the light source device includes a discharge lamp that forms a light source, a voltage application unit that applies to the discharge lamp an AC voltage for operation of the discharge lamp, and a frequency setting unit that sets the frequency of the AC voltage to a first frequency for ignition of the discharge lamp and sets the frequency of the AC voltage to a second frequency during operation of the discharge lamp after the ignition. The second frequency is lower than the first frequency.

A discharge lamp has a characteristic in which a higher frequency of AC voltage for operation of the discharge lamp tends to offer a larger leakage current amount and a lower level of the voltage necessary for ignition of the discharge lamp (discharge start voltage). On the contrary, a lower frequency of the AC voltage for operation of the discharge lamp tends to offer a reduced leakage current amount and a higher level of the voltage necessary for ignition of the discharge lamp (discharge start voltage). A low frequency of the AC voltage for operation of the discharge lamp advantageously imposes a lighter load on the circuit, but leads to a decreased leakage current amount. That is, the start performance of the discharge lamp and the degree of suppression of leakage current, which both depend on the frequency of the AC voltage for operation of the discharge lamp, are in a trade-off relationship.

Therefore, in the above-described configurations according to the embodiments of the invention, an AC voltage with a first frequency for operation of a discharge lamp is applied when the operation of the discharge lamp is started (the discharge lamp is ignited). Subsequently, after the ignition of the discharge lamp, an AC voltage with a second frequency lower than the first frequency is applied so that the operation of the discharge lamp is continued. That is, the frequency of the AC voltage is switched so that an AC voltage with a relatively high frequency is used to ignite the discharge lamp while an AC voltage with a low frequency is used to operate the discharge lamp after the ignition. Thus, the discharge lamp can be ignited smoothly with a low discharge start voltage in a short time period as the ignition time period of the discharge lamp. In addition, during continuation of the operation of the discharge lamp, the amount of leakage current is suppressed.

As described above, embodiments of the invention allow effective suppression of leakage current during operation of a discharge lamp without deteriorating the start performance of the discharge lamp. Thus, the embodiments allow e.g. enhancement of the luminance of the discharge lamp and an improvement of the power conversion efficiency due to reduction of reactive power.

DETAILED DESCRIPTION

Prior to a description of a best mode (embodiment) for carrying out the present invention, a background to the achievement of the invention will be described below with reference to FIGS. 4 and 5.

Figure 4:
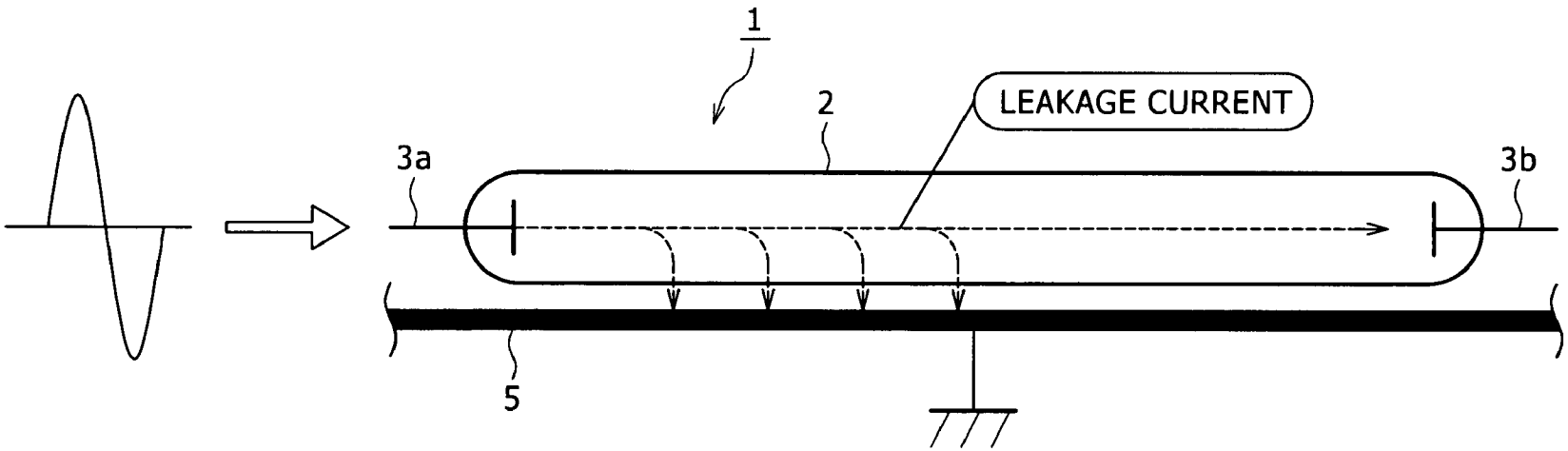
FIG. 4 illustrates the basic structure of a discharge lamp.

FIG. 4 illustrates a discharge lamp 1 that is a cold cathode fluorescent lamp. The discharge lamp 1 includes a sealed container 2 formed by processing an insulating material with optical transparency such as glass into a hollow pillar shape. The inside of the sealed container 2 is a substantially vacuum closed space, and e.g. a mercury gas is enclosed therein as a gas for luminescence. The inner surface of the sealed container 2 is coated with a fluorescent material.

Electrodes 3*a* and 3*b* are provided at the both ends of the longitudinal axis of the space inside the pillar-shaped sealed container 2. These electrodes 3*a* and 3*b* are routed to the external of the sealed container 2 through a conductive material so as to be coupled to e.g. a lamp drive circuit to be described later formed of an inverter circuit and so on.

FIG. 4 also shows an adjacent conductor 5 in addition to the discharge lamp 1. This adjacent conductor 5 is e.g. a casing or frame at the periphery of the discharge lamp 1 and has conductivity. The adjacent conductor 5 is at such a distance from the discharge lamp 1 that the adjacent conductor 5 can be regarded as a member physically adjacent to the discharge lamp 1. The adjacent conductor 5 is connected to the ground.

In order to operate the discharge lamp 1, an AC voltage with a comparatively high level (e.g., about 1,000 V) is applied thereto through the inverter circuit or the like. In actual, the output terminals of the respective poles of an AC power supply (drive AC voltage) are coupled to the electrodes 3*a* and 3*b* of the discharge lamp 1.

The application of the drive AC voltage leads to flow of a displacement current between the electrodes 3*a* and 3*b* in the sealed container 2. Thus, a plasma state in which electrons and mercury atoms collide with each other is caused, which results in luminescence of the discharge lamp 1.

After the start of application of the drive AC voltage for ignition of the discharge lamp 1, the following state transition arises.

Specifically, in response to the start of application of the drive AC voltage, the electrodes 3*a* and 3*b* start discharging of electrons, which generates a current inside the sealed container 2. Part of the current leaks to the outside of the sealed container 2 as leakage current, and flows into the adjacent conductor 5, which neighbors the discharge lamp 1 and is provided with the ground potential.

As schematically shown in FIG. 4, the occurrence of the leakage current proceeds over time from one electrode side (3*a*, 3*b*) toward the other electrode side (3*b*, 3*a*). When the leakage current arrives at the other electrode side, a current flows between the electrodes 3*a* and 3*b* in the sealed container 2, and thus luminescence (operation) is initiated. This state transition from the start of application of the drive AC voltage to the actual ignition of the discharge lamp 1 indicates that leakage current is necessary for the ignition of the discharge lamp 1.

Figure 5:
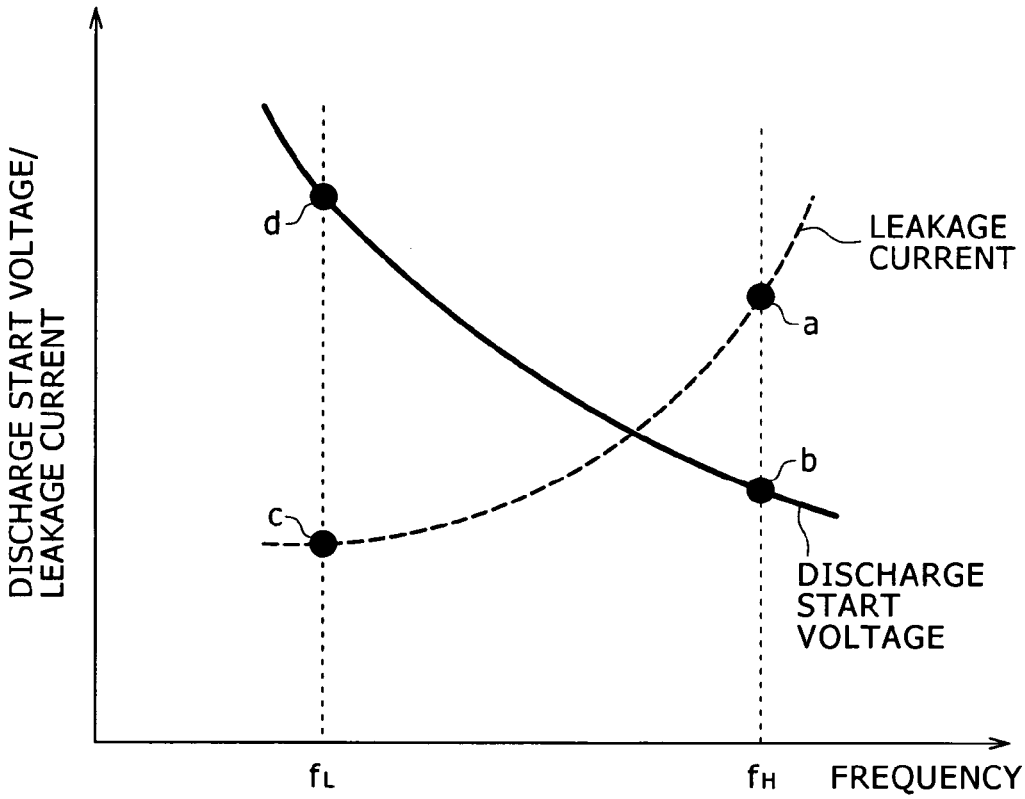
FIG. 5 shows the relationship among the frequency of drive AC voltage, the leakage current amount and discharge start voltage of a discharge lamp.

FIG. 5 shows the relationship among the level of discharge start voltage, the leakage current amount, and the frequency of drive AC voltage. The level of the discharge start voltage refers to the level of the minimum necessary drive AC voltage for ignition of the discharge lamp 1. When the level of the drive AC voltage is lower than a certain level, the state necessary for ignition of the discharge lamp 1 hardly be obtained in the sealed container 2, and thus the ignition may be impossible.

As shown in FIG. 5, the discharge start voltage level has a characteristic of decreasing as the frequency of the drive AC voltage becomes higher. The reason for this characteristic is because an increase of the frequency of the drive AC voltage leads to an effect equivalent to e.g. a decrease of the work function between the electrodes 3*a* and 3*b* in the sealed container 2, and hence electrons are readily discharged.

In contrast, the leakage current amount increases as the frequency of the drive AC voltage becomes higher, due to lowering of the impedance.

Currently, the discharge lamp 1 shown in FIG. 4 is widely used as e.g. a backlight (light source) of a liquid crystal display since it needs no heating and has a long life for example. However, using the discharge lamp 1 as a light source of a liquid crystal display involves the following problems.

The discharge lamp 1 has a structure in which electrodes are disposed at the both ends of the longitudinal axis thereof as shown in FIG. 4, and therefore a physical space distance exists between the electrodes. The discharge start voltage level of the discharge lamp 1 (the level of the minimum necessary drive AC voltage for starting discharge) changes depending on the space distance between the electrodes. Specifically, a longer space distance needs a higher voltage level. This means that, in order to adequately operate the discharge lamp 1, the actual drive AC voltage level needs to be set in consideration of the discharge start voltage level, which depends on the length of the longitudinal axis of the discharge lamp 1 (i.e., the space distance between the electrodes). If the longitudinal axis of the discharge lamp 1 is longer, the level of the drive AC voltage needs to be set to a higher level correspondingly. This causes a severe problem associated with particularly recent size increases of display panels in liquid crystal displays.

When the discharge lamp 1 shown in FIG. 4 is used as a backlight of a liquid crystal display, typically the discharge lamp 1 is disposed so that the longitudinal axis thereof is parallel to the horizontal direction of the liquid crystal panel. Accordingly, an increase in the size of a liquid crystal panel in a liquid crystal display leads to an increase in the length of the longitudinal axis of the discharge lamp 1.

If the longitudinal axis of the discharge lamp 1 becomes longer, the physical distance between the electrodes 3*a* and 3*b* also becomes larger, and hence the discharge start voltage level becomes higher correspondingly. Therefore, in actual, it is difficult to start the operation of the discharge lamp 1 with use of a drive AC voltage level used in a conventional lamp drive circuit (inverter circuit, etc.). Consequently, in a lamp drive circuit for a backlight of a large-size liquid crystal display, there is a need to apply to the discharge lamp 1 a drive AC voltage with a higher level than conventional voltage levels.

However, a higher level of the drive AC voltage leads to a heavier burden on the lamp drive circuit correspondingly, which needs a change of the lamp drive circuit as a countermeasure against the heavier burden. Specifically, the burden on the circuit needs to be reduced through e.g. choosing of higher-breakdown-voltage products as various components in the lamp drive circuit and increasing of the size of components such as an inverter transformer. These changes however cause a problem of size and cost increases of the lamp drive circuit.

However, if the frequency of the drive AC voltage is set to a high value, the rise of the discharge start voltage level associated with a length increase of the discharge lamp 1 can be suppressed. This is because the discharge start voltage level has a characteristic of decreasing as the frequency of the drive AC voltage becomes higher as shown in FIG. 5. Furthermore, a higher frequency of the drive AC voltage offers a larger amount of leakage current, which is necessary for starting discharge, as described above, and therefore a state in which discharge can be started more readily is achieved. That is, increasing the frequency of the drive AC voltage allows favorable discharge start operation even when the discharge lamp 1 has a long length.

Although the leakage current from the discharge lamp 1 is necessary for ignition of the discharge lamp 1, it is not required for keeping of the operating state after the ignition. In addition, the leakage current arises from the leak of current that should flow between the electrodes in the sealed container 2 to the outside, and therefore the occurrence of the leakage current correspondingly reduces the amount of current inside the sealed container 2. Accordingly, it is preferable that the leakage current during stationary operation of the discharge lamp 1 be as small as possible since the leakage current is a factor in a decrease of the operation luminance of the discharge lamp and an increase in power consumption due to an increase in reactive power.

In a conventional device, however, the frequency of the drive AC voltage generated from the lamp drive circuit is fixed. Therefore, if the frequency of the drive AC voltage is set to a high value as described above, the leakage current when the operating state of the discharge lamp 1 is maintained after the ignition is inevitably large.

Thus, it is difficult for present devices to simultaneously achieve both of enhancement of the operation start performance and reduction of the leakage current during the operation for enhancement of the luminance and reduction of the power consumption.

In terms of the above-described technical background, proposed as an embodiment of the invention is a configuration that allows the operation of a discharge lamp and can achieve both of enhancement of the operation start performance and reduction of leakage current during the operation.

Referring again to FIG. 5, a consideration will be made with use of an assumption that the frequencies fH and fL are set as the frequency of the drive AC voltage. The frequencies fH and fL each have a certain predetermined value and have the relative relationship fH>fL. Therefore, the frequencies fH and fL can be regarded as high and low frequencies, respectively, of the drive AC voltage.

A condition in which the frequency of the drive AC voltage is a high frequency like the frequency fH provides a large leakage current amount and a low discharge start voltage level, and therefore is suitable for ignition of the discharge lamp 1 also as described above. However, this condition is disadvantageous for maintaining the operation of the discharge lamp 1 since the condition offers a large leakage current amount.

In contrast, a condition in which the frequency of the drive AC voltage is a low frequency like the frequency fL is disadvantageous for ignition since the discharge start voltage is high, but is advantageous for maintaining of the operation since the leakage current amount is small. It should be noted that the discharge start voltage corresponds to the minimum value of the drive voltage level needed for ignition of the discharge lamp 1, and after the ignition, the operation of the lamp can be maintained even with a drive AC voltage lower than the discharge start voltage.

From the above description, the following conclusion can be obtained regarding the operation of a discharge lamp. Specifically, for start of operation, a high frequency of the drive AC voltage is advantageous since it offers a state in which the operation is readily started. In contrast, for maintaining of the operation, a low frequency of the drive AC voltage is advantageous since it offers a reduced leakage current amount.

Therefore, in driving of a discharge lamp for the operation thereof in the present embodiment, the frequency of the drive AC voltage is changed between high and low frequencies depending on the state of the discharge lamp. Specifically, for start of the operation (ignition) of the discharge lamp, a correspondingly high frequency is set. In contrast, for continuation and maintaining of the operation of the discharge lamp after the start of the operation, a correspondingly low frequency is set. Thus, at the start of the operation, the leakage current is increased while the discharge start voltage is decreased, which provides a condition favorable for starting the operation of the discharge lamp 1 and hence offers a favorable start performance. In contrast, when the operation of the discharge lamp is maintained, the leakage current is sufficiently suppressed, which allows a valid current amount to be kept in the discharge lamp 1. That is, the present embodiment can enhance the luminance of a discharge lamp and reduce the power consumption without deteriorating a favorable start performance.

Figure 1:
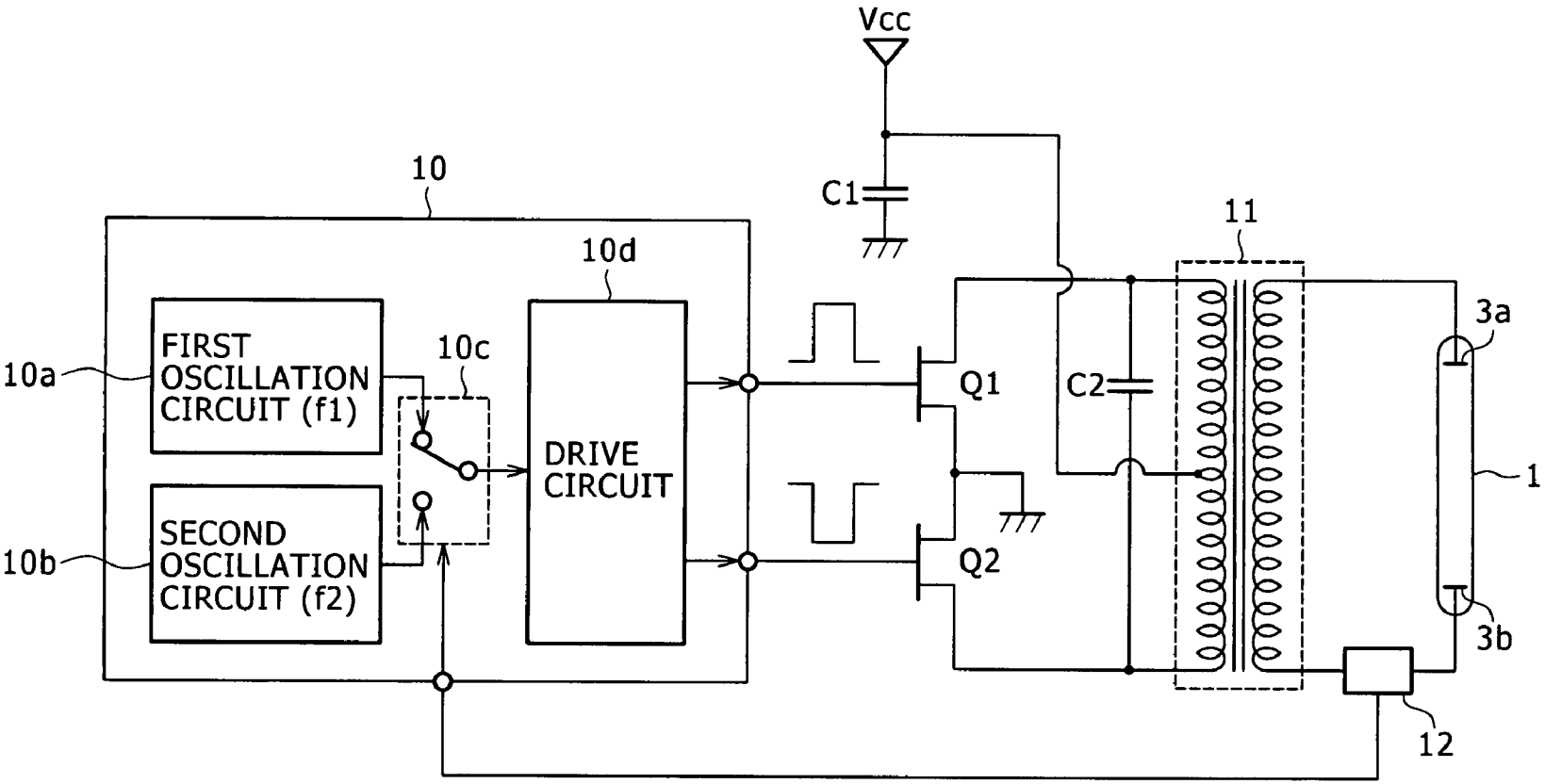
FIG. 1 illustrates a configuration example of a lamp drive circuit for a discharge lamp as an embodiment of the present invention.

FIG. 1 illustrates a configuration example of a lamp drive circuit for a discharge lamp as the present embodiment. This lamp drive circuit can change the frequency of the drive AC voltage between the frequency for ignition of the discharge lamp and the frequency for maintaining the operation after the ignition.

An oscillation drive circuit 10 in the lamp drive circuit of FIG. 1 is to turn transistors Q1 and Q2 on and off by separate excitation. The oscillation drive circuit 10 includes, as internal components thereof, a first oscillation circuit 10*a*, a second oscillation circuit 10*b*, a switch 10*c* and a drive circuit 10*d*.

The first oscillation circuit 10*a* generates an oscillation signal with a predetermined frequency f1. The second oscillation circuit 10*b* generates an oscillation signal with a predetermined frequency f2 that is lower than the frequency f1. The switch 10*c* selects either one of the oscillation signals generated by the first and second oscillation circuits 10*a* and 10*b*, and the selected signal is input to the drive circuit 10*d*. The switch-over of the signal by the switch 10*c* is carried out according to a detection signal output from a detection circuit 12 to be described later.

The drive circuit 10*d* utilizes the input oscillation signal to produce a drive signal (gate drive voltage) and apply the drive signal to the gates of the transistors Q1 and Q2. Due to the applied drive signal, the transistors Q1 and Q2 are alternately turned on and off with the switching cycle dependent upon the frequency of the input oscillation signal.

A MOSFET is chosen as the transistors Q1 and Q2. The drain of the transistor Q1 is connected to one end of a primary winding in an inverter transformer 11. The source of the transistor Q1 is connected to the drain of the transistor Q2 at the ground potential. The source of the transistor Q2 is connected to the other end of the primary winding of the inverter transformer 11. The primary winding of the inverter transformer 11 is provided with a center tap, and the center tap is connected to a power supply that provides a DC supply voltage Vcc with a predetermined level. In this circuit, the DC supply voltage Vcc is indicated as the voltage across a capacitor C1.

In addition, a capacitor C2 is connected in parallel to the primary winding of the inverter transformer 11. Thus, e.g. the primary winding and the capacitor C2 form a parallel resonant circuit.

One end of a secondary winding of the inverter transformer 11 is connected to the electrode 3*a* of the discharge lamp 1. The other end of the secondary winding is coupled via the detection circuit 12 to the electrode 3*b* of the discharge lamp 1. Although not shown in FIG. 5, the adjacent conductor 5 is disposed near the discharge lamp 1 similarly to the structure shown in FIG. 4.

The detection circuit 12 includes e.g. a detection resistor, and detects a current that flows through the circuit formed of the secondary winding of the inverter transformer 11 and the discharge lamp 1. The detection circuit 12 outputs a detection signal that indicates whether or not the discharge lamp 1 has entered the operating state and the amount of the current flowing through the circuit is equal to or larger than a certain value. The switch 10*c* of the oscillation drive circuit 10 implements switching operation depending upon the detection signal. Specifically, when a detection signal indicating that the current amount is smaller than the certain value (the discharge lamp 1 has not been ignited) is output, the switch 10*c* selects an oscillation signal from the first oscillation circuit 10*a* and outputs it to the drive circuit 10*d*. In contrast, when a detection signal indicating that the current amount is equal to or larger than the certain value (the discharge lamp 1 has been ignited) is output, the switch 10*c* selects an oscillation signal from the second oscillation circuit 10*b* and outputs it to the drive circuit 10*d*.

The operation of the thus constructed lamp drive circuit is as follows.

As the basic operation of the lamp drive circuit, the oscillation drive circuit 10 applies a drive signal that has either one of the frequencies f1 and f2 to the transistors Q1 and Q2. Thus, the transistors Q1 and Q2 are alternately turned on and off with the switching cycle dependent upon the frequency f1 or f2. The frequencies f1 and f2 are on the order of several tens of kilohertz. In response to the ON/OFF operation of the transistors Q1 and Q2, a current flows through the primary winding of the inverter transformer 11 in the positive/negative directions, which induces an AC voltage dependent upon the switching cycle in the secondary winding of the inverter transformer 11. This AC voltage is applied to the discharge lamp 1 as the drive AC voltage, so that the discharge lamp 1 is driven to be operated. As described above, the lamp drive circuit shown in FIG. 1 employs a configuration as an inverter that is fed with the DC supply voltage Vcc and converts it into an AC supply voltage with a frequency of e.g. several tens of kilohertz, so that the AC supply voltage allows the discharge lamp 1 to be operated.

In addition, as is apparent from the above description, the present embodiment employs the oscillation drive circuit 10 that includes two oscillation circuits 10*a* and 10*b* so that the frequency of the ON/OFF operation of the transistors Q1 and Q2 can be switched between the frequencies f1 and f2. According to the operation of the lamp drive circuit, the frequency of the ON/OFF operation of the transistors Q1 and Q2 corresponds with the frequency of the drive AC voltage applied to the discharge lamp 1. Accordingly, it can be said that the frequency of the drive AC voltage can be switched between the frequencies f1 and f2 in the present embodiment.

Furthermore, due to the above-described switching operation of the switch 10*c* dependent upon the detection signal from the detection circuit 12, the frequency of the drive AC voltage is switched as follows: it is set to the frequency f1 when the discharge lamp 1 has not been ignited, while it is set to the frequency f2 when the discharge lamp 1 has been ignited. More specifically, in the present embodiment, when the operation of the discharge lamp 1 is started so that the discharge lamp 1 is turned from the non-operating state to the operating state, the drive AC voltage with the high frequency f1 is applied to the discharge lamp 1. In contrast, when the operation of the discharge lamp 1 is maintained after the start of the operation, the drive AC voltage with the low frequency f2 is applied to the discharge lamp 1. In this manner, the present embodiment achieves a configuration that changes the frequency of the drive AC voltage depending upon whether the discharge lamp 1 is in the operating or non-operating state. Note that hereinafter the frequency f1 will be referred to also as an ignition frequency and the frequency f2 will be referred to also as an operation keep frequency.

As the configuration for changing the frequency of the drive AC voltage depending upon the operating/non-operating state of the discharge lamp 1, another configuration other than the configuration in which the detection circuit detects the presence of current conduction in the discharge lamp 1 may be used. For example, a configuration is also available in which time setting for switching the frequency is implemented with use of a time constant circuit or the like, with the time period from the start of application of the drive AC voltage to the discharge lamp 1 to the start of the operation of the discharge lamp 1 being estimated, so that the frequency is switched based on the time setting. However, it is known that the initiation of the actual discharge lamp 1 has a temperature dependency. That is, the time period from the start of application of the drive AC voltage to the start of the operation and current conduction changes depending on the temperature. Therefore, the configuration in which a time constant is merely set to thereby change the frequency of the drive AC voltage involves a possibility that the timing of the frequency switching does not match the actual operation state of the discharge lamp and thus the operation becomes unstable. For that reason, the present embodiment employs the configuration in which the detection circuit 12 detects the presence of current conduction in the discharge lamp 1 to thereby change the frequency.

Figure 2:
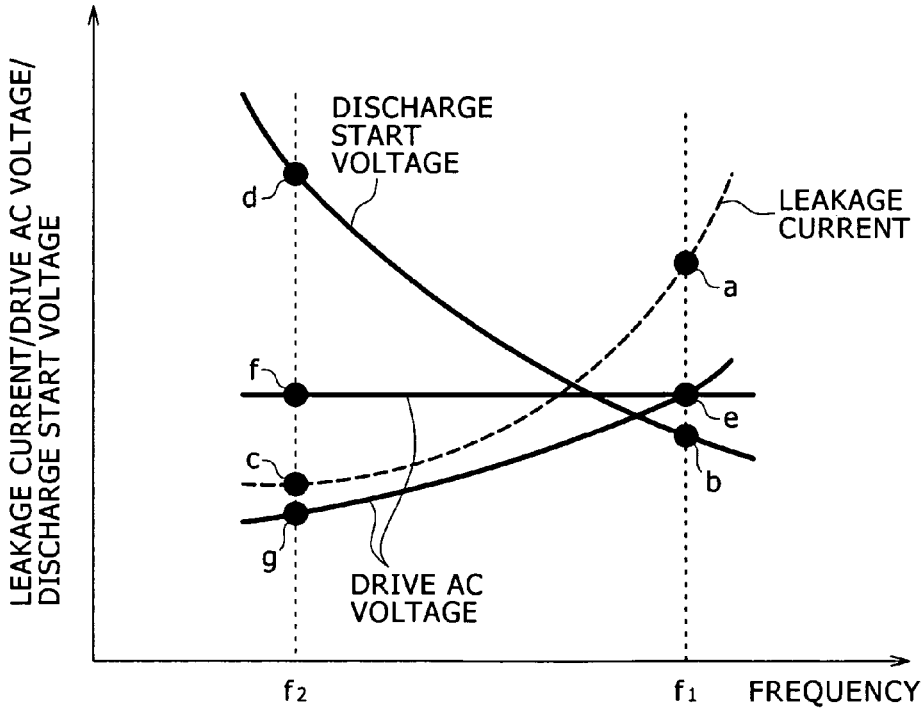
FIG. 2 is a diagram for explaining conditions relating to the setting of an ignition frequency f1 and an operation keep frequency f2.

A description will be made about conditions for setting the frequencies f1 and f2 of the drive AC voltage in the present embodiment with reference to FIG. 2. In addition, a description will also be made on the setting of the level of the drive AC voltage applied to the discharge lamp 1. FIG. 2 shows the leakage current amount and the levels of the drive AC voltage and discharge start voltage in association with the frequency of the drive AC voltage. In the drawing, the frequency of the drive AC voltage is indicated on the abscissa, while the leakage current amount, and the levels of the drive AC voltage and discharge start voltage are indicated on the ordinate. The level of the drive AC voltage shown in FIG. 2 indicates the level of the drive AC voltage that should be actually set in the lamp drive circuit. The level of the discharge start voltage shown in FIG. 2 indicates the level of the minimum necessary drive AC voltage for start of the discharge of the discharge lamp 1 similarly to FIG. 5.

The ignition frequency f1 needs to be set so that at least a certain leakage current amount that is equal to or larger than the minimum necessary amount for starting the operation is obtained. In FIG. 2, the ordinate value of the coordinate a corresponds to the leakage current amount that is defined as the necessary amount for ignition. Therefore, the ignition frequency f1 is set to the abscissa value of the coordinate a.

Furthermore, the discharge start voltage associated with the ignition frequency f1 has the level indicated by the coordinate b. Also as described above, the discharge start voltage indicates the level of the minimum necessary voltage for starting discharge. Therefore, if the level of the discharge start voltage is directly employed as the actual drive AC voltage level, the actual voltage level has no margin for error. Accordingly, if the level of the actually applied drive AC voltage becomes lower than the predefined level due to any reason, the start of the discharge is not expected. For that reason, in the present embodiment, the drive AC voltage level is set to the level indicated by the coordinate e, which is larger by a certain level than the level corresponding to the coordinate b, so that a margin for error is ensured.

Even if a level larger than the discharge start voltage level is thus used as the drive AC voltage level for a certain margin in the present embodiment, this drive AC voltage level is lower than conventional voltage levels. The ignition frequency f1 is temporarily used only for starting the operation, and therefore can be set to a frequency higher than conventional frequencies. This high frequency offers a reduced discharge start voltage. Therefore, a drive AC voltage level that is equal to or lower than conventional voltage levels can be used even if this drive AC voltage level is larger than the discharge start voltage level for a certain margin.

The operation keep frequency f2 can be set as follows.

As described above, although at least a certain amount of leakage current is necessary for ignition of a lamp, the leakage current is unnecessary when the operation of the lamp is maintained after the ignition. Therefore, it is preferable for the leakage current to be reduced as far as possible during the operation. Consequently, the operation keep frequency f2 is set to a frequency that offers a leakage current amount small enough that an aimed improvement is achieved regarding the luminance and power consumption of the discharge lamp 1 for example. Specifically, in FIG. 2, the leakage current amount indicated by the coordinate c is defined as the amount that offers the aimed improvement, and the frequency corresponding to the coordinate c is set as the operation keep frequency f2.

As a way of setting the drive AC voltage level associated with the operation keep frequency f2, the following two ways are available.

In one way, the same voltage level as the level indicated by the coordinate e, which is set for the ignition frequency f1, is set. That is, the level indicated by the coordinate f in FIG. 2 is set. In this case, there is no need to change the drive AC voltage level in response to switching of the frequency of the drive AC voltage (oscillation signal) between the frequencies f1 and f2. Therefore, the lamp drive circuit is allowed to output the drive AC voltage with a constant level invariably, and thus the configuration of the circuit can be simplified correspondingly, which reduces the burden on circuit design and suppresses cost increases.

In the other setting way, a level is set that is lower than the level indicated by the coordinate e, which is set for the ignition frequency f1, but imposes no problem on maintaining of the operation of the discharge lamp 1. As described above, the discharge start voltage has no particular relation to the maintaining of the operation, and therefore a level lower than the discharge start voltage level can be used as the drive AC voltage level. In FIG. 2, the level corresponding to the coordinate g is used as the level that is lower than the level indicated by the coordinate e but imposes no problem on the keeping of the operation of the discharge lamp 1.

If the drive AC voltage level when operation is maintained is thus set lower than that when operation is started, the drive AC voltage level can be maintained at an appropriately low level constantly when the discharge lamp is normally operated. Thus, e.g. reduction of power consumption can be achieved. In addition, the level of the voltage that is constantly applied to the discharge lamp 1 and predetermined circuits is also decreased, and hence a load on circuit components due to the voltage withstanding thereof is reduced, which contributes to e.g. life extension. As a configuration for switching the drive AC voltage level between the level for ignition and the level for maintaining operation, e.g. a configuration is available in which the level of the DC supply voltage Vcc that is input to the inverter circuit is varied. Alternatively, if the circuit has the configuration of FIG. 1, modulating the pulse width of a drive voltage applied to the transistors Q1 and Q2 also allows variation of the drive AC voltage level.

Figure 3:
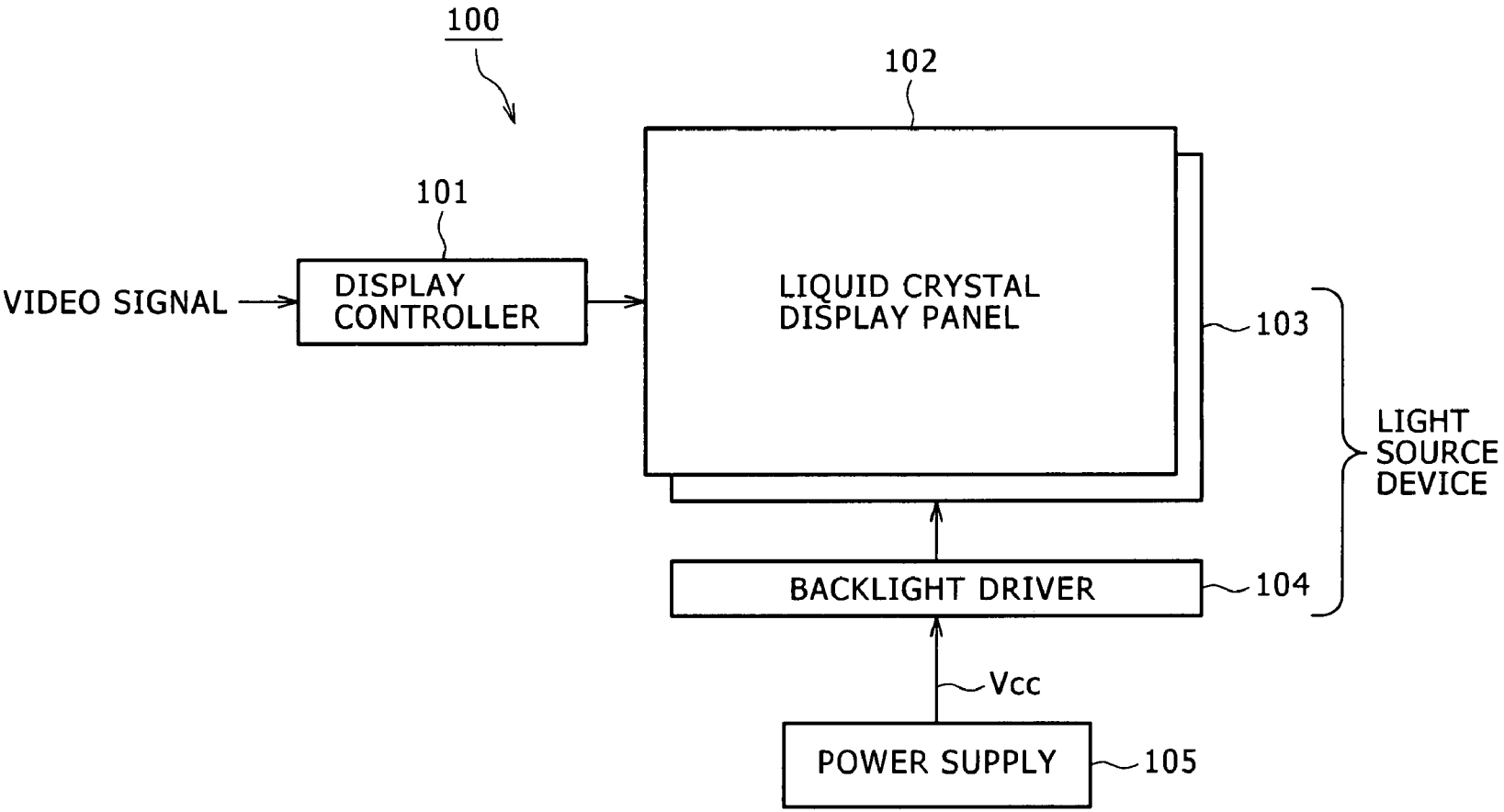
FIG. 3 illustrates a configuration example of a liquid crystal display to which a discharge lamp operated by the lamp drive circuit of the embodiment can be applied as a light source.

FIG. 3 is a diagram schematically illustrating the configuration of a liquid crystal display 100 as an example of a display to which a light source device based on the lamp drive circuit for a discharge lamp as the above-described embodiment can be applied.

The liquid crystal display 100 shown in the drawing includes a liquid crystal display panel 102 as a display screen and a backlight unit 103 that is provided on the backside of the liquid crystal display panel 102. As is well known, the liquid crystal display panel 102 is formed by enclosing a liquid crystal layer between glass substrates and arranging pixel switches formed of semiconductor devices in a matrix according to a predetermined resolution.

The backlight unit 103 includes the certain discharge lamps 1 that are arranged in a predetermined pattern as a light source. For example, several discharge lamps 1 compatible with the size of the liquid crystal display panel 102 are prepared and arranged at a predetermined interval across the column direction of the panel 102 so that the longitudinal axis of the discharge lamps 1 is parallel to the horizontal direction of the screen of the liquid crystal display panel 102. White light arising from operation of these discharge lamps 1 is emitted, with being scattered, from the backside of the liquid crystal display panel 102 toward the frontside thereof.

The discharge lamps 1 included in the backlight unit 103 are driven by a backlight driver 104 to emit light. The backlight driver 104 operates based on the DC voltage Vcc supplied from a power supply 105.

The pixel switches in the liquid crystal display panel 102 are driven by a display controller 101. The display controller 101 receives a video signal for displaying, and implements horizontal/vertical scan driving for the liquid crystal display panel 102 in accordance with the input video signal to thereby control the ON/OFF operation of the pixel switches. Thus, driving is implemented so that the polarization direction of the liquid crystal layer corresponding to the pixel switches is varied, which modulates light that is to pass through the liquid crystal display panel 102 from the backside toward the frontside thereof. As a result, images are displayed on the screen of the liquid crystal display panel 102.

In FIG. 3, the light source device to which the lamp drive circuit shown as the embodiment is applied can be regarded as the combination of the requisite number of the discharge lamps 1 as a light source included in the backlight unit 103 and the lamp drive circuit that has the configuration of FIG. 1 and operates these discharge lamps 1. The lamp drive circuit with the configuration of FIG. 1 included in the backlight driver 104 may be individually provided for each of the actually prepared discharge lamps 1 in the backlight unit 103. Alternatively, one lamp drive circuit may be connected in parallel to a plurality of discharge lamps 1 so that the plurality of discharge lamps 1 can be operated by the one lamp drive circuit.

It should be noted that the present invention is not limited to the above-described configurations as the embodiments. For example, in the configuration of FIG. 1, the lamp drive circuit includes a first oscillation circuit 10*a*, a second oscillation circuit 10*b* and a switch 10*c*; the frequency of the drive AC voltage is switched stepwise between the frequency f1 of the first oscillation circuit 10*a* and the frequency f2 of the second oscillation circuit 10*b*, which correspond to the start of operation and the maintaining of operation, respectively. However, instead of this, a circuit configuration, with only one oscillation circuit, in which the frequency is changed in a continuous manner between the frequencies f1 and f2, which corresponds to the condition of the current conduction in the discharge lamp 1 may be used.

Furthermore, although FIG. 3 shows a liquid crystal display as an example of displays, the invention can also be applied to other displays employing a display device that needs a light source. In a display based on the configuration of an embodiment of the invention, the above-described advantages become greater in particular as the display panel size becomes larger. However, the advantages of enhancement of luminance and reduction of power consumption are achieved similarly irrespective of the display panel size.

The discharge lamp can be used not only as a light source of a liquid crystal display but also as a light source of e.g. an illuminator, and embodiments of the invention can be applied as a circuit or device for driving the light source of the illuminator. Moreover, although the above-described embodiment employs a cold cathode tube as a discharge lamp, the invention can also be applied to other discharge lamps that have characteristics similar to those of the cold cathode tubes regarding the relationship among the drive voltage frequency, leakage current amount, and discharge start voltage.

The invention claimed is:

1. A discharge lamp operating apparatus comprising:

a cold cathode fluorescent type discharge lamp having a sealed container with an inner surface which is coated with a fluorescent material;

voltage application means that applies to the discharge lamp an alternating-current voltage for operation of the discharge lamp; and frequency setting means that sets a frequency of the alternating-current voltage to a first frequency for ignition of the discharge lamp and sets the frequency of the alternating-current voltage to a second frequency during operation of the discharge lamp after the ignition, the second frequency being lower than the first frequency, wherein the voltage application means sets a first application level of the alternating-current voltage that is applied to the discharge lamp, based on a minimum level of the alternating-current voltage necessary for start of discharge of the discharge lamp when the frequency of the alternating-current voltage is set to the first frequency.

2. The discharge lamp operating apparatus according to claim 1, wherein the first frequency is defined based on such a frequency of the alternating-current voltage that a minimum level of the alternating-current voltage necessary for start of discharge of the discharge lamp is equal to or lower than a predetermined level.

3. The discharge lamp operating apparatus according to claim 1, wherein the voltage application means sets a predetermined level lower than the first application level as a second application level that is a level of the alternating-current voltage that is applied to the discharge lamp when the frequency of the alternating-current voltage is set to the second frequency.

4. A discharge lamp operating device comprising:

voltage application means that applies to a discharge lamp an alternating-current voltage for operation of the discharge lamp; and frequency setting means that sets a frequency of the alternating-current voltage to a first frequency for ignition of the discharge lamp and sets the frequency of the alternating-current voltage to a second frequency during operation of the discharge lamp after the ignition, the second frequency being lower than the first frequency, wherein the first frequency is defined based on such a frequency of the alternating-current voltage that an amount of a leakage current that is generated from the discharge lamp in response to application of the alternating-current voltage is equal to or larger than a predetermined amount.

5. A discharge lamp operating device comprising:

voltage application means that applies to a discharge lamp an alternating-current voltage for operation of the discharge lamp; and frequency setting means that sets a frequency of the alternating-current voltage to a first frequency for ignition of the discharge lamp and sets the frequency of the alternating-current voltage to a second frequency during operation of the discharge lamp after the ignition, the second frequency being lower than the first frequency, wherein the second frequency is defined based on such a frequency of the alternating-current voltage that an amount of a leakage current that is generated from the discharge lamp in response to application of the alternating-current voltage is equal to or smaller than a predetermined amount.

6. A discharge lamp operating method comprising:

applying to a cold cathode fluorescent type discharge lamp an alternating-current voltage for operation of the discharge lamp when the discharge lamp is ignited, the alternating-current voltage having a first frequency, the cold cathode fluorescent type discharge lamp having a sealed container with an inner surface which is coated with a fluorescent material; and applying to the discharge lamp an alternating-current voltage having a second frequency lower than the first frequency when operation of the discharge lamp is maintained after ignition of the discharge lamp, wherein an application level of the alternating-current voltage that is applied to the discharge lamp is set, based on a minimum level of the alternating-current voltage necessary for start of discharge of the discharge lamp when the frequency of the alternating-current voltage is set to the first frequency.

7. A display including a light source device and an image display panel that displays an image by use of light emitted from the light source device, the light source device comprising:

a cold cathode fluorescent type discharge lamp having a sealed container with an inner surface which is coated with a fluorescent material that forms a light source;

voltage application means that applies to the discharge lamp an alternating-current voltage for operation of the discharge lamp; and frequency setting means that sets a frequency of the alternating-current voltage to a first frequency for ignition of the discharge lamp and sets the frequency of the alternating-current voltage to a second frequency during maintaining of operation of the discharge lamp after the ignition, the second frequency being lower than the first frequency, wherein the voltage application means sets a first application level of the alternating-current voltage that is applied to the discharge lamp, based on a minimum level of the alternating-current voltage necessary for start of discharge of the discharge lamp when the frequency of the alternating-current voltage is set to the first frequency.

8. The display according to claim 7, wherein the voltage application means sets a predetermined level lower than the first application level as a second application level that is a level of the alternating-current voltage that is applied to the discharge lamp when the frequency of the alternating-current voltage is set to the second frequency.

9. A discharge lamp operating apparatus comprising:

a cold cathode fluorescent type discharge lamp having a sealed container with an inner surface which is coated with a fluorescent material;

a voltage application unit configured to apply to the discharge lamp an alternating-current voltage for operation of the discharge lamp; and a frequency setting unit configured to set a frequency of the alternating-current voltage to a first frequency for ignition of the discharge lamp and set the frequency of the alternating-current voltage to a second frequency during operation of the discharge lamp after the ignition, the second frequency being lower than the first frequency, wherein the voltage application unit is configured to set a first application level of the alternating-current voltage that is applied to the discharge lamp, based on a minimum level of the alternating-current voltage necessary for start of discharge of the discharge lamp when the frequency of the alternating-current voltage is set to the first frequency.

* * * * *